United States Patent [19]

Kando et al.

[11] Patent Number: 4,737,817

[45] Date of Patent: Apr. 12, 1988

[54] ELECTROPHOTOGRAPHIC APPARATUS

[75] Inventors: Giichi Kando; Mineo Shibata, both of Morioka; Minoru Sato, Tamayama, all of Japan

[73] Assignee: Alps Electric Co., Ltd., Japan

[21] Appl. No.: 934,004

[22] Filed: Nov. 24, 1986

[30] Foreign Application Priority Data

Dec. 10, 1985 [JP] Japan ..... 60-189993[U]

[51] Int. Cl.[4] ..... G03G 15/00

[52] U.S. Cl. ..... 355/3 DR; 355/3 R

[58] Field of Search ..... 355/3 R, 3 DR

[56] References Cited

U.S. PATENT DOCUMENTS

| | | | |
|---|---|---|---|
| 3,936,173 | 2/1976 | Kidd et al. | 355/3 R |
| 4,470,689 | 9/1984 | Nomura et al. | 355/3 DR |
| 4,534,641 | 8/1985 | Gilliland et al. | 355/3 R |
| 4,575,221 | 3/1986 | Onoda et al. | 355/3 DR |

*Primary Examiner*—Peter S. Wong

*Attorney, Agent, or Firm*—Guy W. Shoup

[57] ABSTRACT

This invention provides an electrophotographic apparatus of the type wherein an upper unit open-/close-able with respect to a lower unit is provided with a sensitizing drum and a de-electrifying light source for eliminating residual potential on the sensitizing drum, which is characterized in that the de-electrifying light source is a membrane light emitting element, and this membrane light emitting element is movable so as to make open and closed the lower part of the sensitizing drum.

3 Claims, 5 Drawing Sheets

ELECTROPHOTOGRAPHIC APPARATUS

BACKGROUND OF THE INVENTION

1. Field of the Invention

This invention relates to an electrophotographic apparatus for forming visible images corresponding to picture information on a recording medium by developer which is adapted for use as picture output devices, such as facsimile, copying machine, laser printer, LED printer, and liquid crystal printer, and, more particularly, to an improvement of an electrophotographic apparatus of the so-called shell-open type wherein an upper unit is open-/close-able with respect to a lower unit.

2. Description of the Prior Art

Recently, in order to miniaturize the electrophotographic apparatus and facilitate its maintenance, as shown in FIGS. 3 and 4, the so-called shell-open type of electrophotographic apparatus 1 has been devised wherein an upper unit 2 is open-/close-able with respect to a lower unit 3. This electrophotographic apparatus 1 will first be described with reference to FIGS. 3 and 4.

The upper unit 2 is supported pivotably by a horizontal support shaft 5 held by a bracket 5 provided in the end portion of the lower unit 3, and a cartridge unit 6 is equipped laterally detachably to the upper unit 2 which supports a sensitizing drum 7 whose lower part is opened to the exterior. In the cartridge unit 6 there are attached so as to surround the sensitizing drum 7 an electrifying unit 8 for electrifying the electrophotographic apparatus 1 to a certain potential through corona discharge, a developing unit 9 for attracting toner and attaching to electrostatic latent images on the sensitizing drum 7 by the use of a developing roll 10 to thereby form visible images, and a cleaner 11 for mechanically removing the toner remaining on the sensitizing drum 7. Inside the upper unit 2 there is mounted an optical writing unit 12 for forming electrostatic latent images corresponding to the picture information of a copy on the sensitizing drum 7 having been given a uniform charge by the electrifying unit 8.

On the other hand, a paper feed cassette 14 is provided detachably in the end portion of the lower unit 3, which stores therein a number of recording papers 13 piled one upon another. Inside the lower unit 3 and above the end portion of the paper feed cassette 14 there is disposed a paper feed roller 15 for supplying the recording papers 13 stored in the paper feed cassette 14 one after another.

Further, inside the lower unit 3 there is formed a conveyor path 16 for horizontally conveying the recording paper 13 given from the paper feed cassette 14, which includes a plurality of pairs of conveyor rollers 17, 17 arranged therein. Furthermore, in the end portion of the conveyor path 16 there is provided a fixing unit 18 for fixing the toner attached to the recording paper 13. The recording paper 13 passed through the fixing unit 18 is ejected onto a tray 20 by ejecting rollers 19, 19. In addition, a transfer unit 21 is provided below the conveyor path 16 at a position coming into opposition to the lower part of the sensitizing drum 7 disposed in the upper unit 2 when the upper unit 2 is closed.

When to form a picture on the recording paper 13 by the use of the foregoing configuration, with keeping the upper unit 2 in the closed state, the sensitizing drum 7 is electrified to a certain potential by the electrifying unit 8 and an electrostatic latent image is formed through exposure on the surface of the sensitizing drum 7 by means of the optical writing unit 12. Thereafter, the toner in the developing unit 9 is attracted by the developing roll 10 and attached selectively to the sensitizing drum 7, whereby a visible image corresponding to the electrostatic latent image is formed. During the above process one recording paper 13 is supplied from the paper feed cassette 14 to the conveyor path 16 by the paper feed roller 15, and when this recording paper 13 comes to the station between the sensitizing drum 7 and the transfer unit 21, the visible image on the sensitizing drum 7 is transferred to the recording paper 13 by causing corona discharge from the back of the recording paper 13 by means of the transfer unit 21. The thus transferred visible image is fixed on the recording paper 13 by the fixing unit 18 and then the paper is ejected onto the tray 20.

On the other hand, residual surface potential existing in non-exposed portions of the sensitizing drum 7 is optically made to zero potential by a de-electrifying light source not shown, and the toner not transferred and remaining on the sensitizing drum 7 is removed from the electrophotographic apparatus 1 by the cleaner 11.

In the conventional electrophotographic apparatus 1 described above, if jamming occurs when the recording paper 13 comes out of the paper feed cassette 14 or while it is being conveyed through the conveyor path 16, usually, the recording paper 13 under trouble is pulled out by pivoting the upper unit 2 about the support shaft 5 and opening the upper part of the lower unit 3, as shown in FIG. 4. But, this opened state causes inevitably the lower part of the sensitizing drum 7 to be exposed. Thus, deterioration of the sensitizing drum 7 is accelerated as it is exposed to the light, and formation of the electrostatic latent image becomes questionable if the hand touches the sensitizing drum 7 erroneously when the recording paper 13 is taken out.

For overcoming the above drawbacks, another type of electrophotographic apparatus is also known in the prior art, as shown in FIG. 5, in which the cartridge unit 6 is provided with an arcuate drum cover 22 laterally movable in response to control of a lever not shown. This drum cover 22 is normally urged so as to cover the lower part of the sensitizing drum 7 by a spring, as illustrated by the imaginary line in FIG. 5, and as the upper unit is closed, can assume a retracted position as illustrated by the solid line in FIG. 5 by means of an arm not shown.

According to the configuration above, however, the sensitizing drum 7 of the cartridge unit 6 needs a space on its side for accommodating the drum cover 22, this making difficult miniaturization. Further, it has the problem that the range in which the light of a de-electrifying light source 23 for eliminating the residual potential of the sensitizing drum 7 reaches the sensitizing drum 7 becomes narrow; thus, the efficiency of de-electrification is degraded.

SUMMARY OF THE INVENTION

It is an object of the present invention to overcome the foregoing problems of the prior art, thus to provide an electrophotographic apparatus which is miniaturizable in addition to protecting a sensitizing drum.

To achieve the foregoing object, the present invention provides an electrophotographic apparatus of the type wherein an upper unit open-/close-able with respect to a lower unit is provided with a sensitizing drum and a de-electrifying light source for eliminating residual potential on the sensitizing drum, which is characterized in that the de-electrifying light source is a membrane light emitting element, and this membrane light emitting element is movable so as to make open and closed the lower part of the sensitizing drum.

According to the present invention, the de-electrifying light source for eliminating the residual potential on the sensitizing drum is realized by the membrane light emitting element provided movably and the lower part of the sensitizing drum is protected by the membrane light emitting element, whereby the apparatus can be miniaturized.

DESCRIPTION OF THE PREFERRED EMBODIMENT

Figure 1:
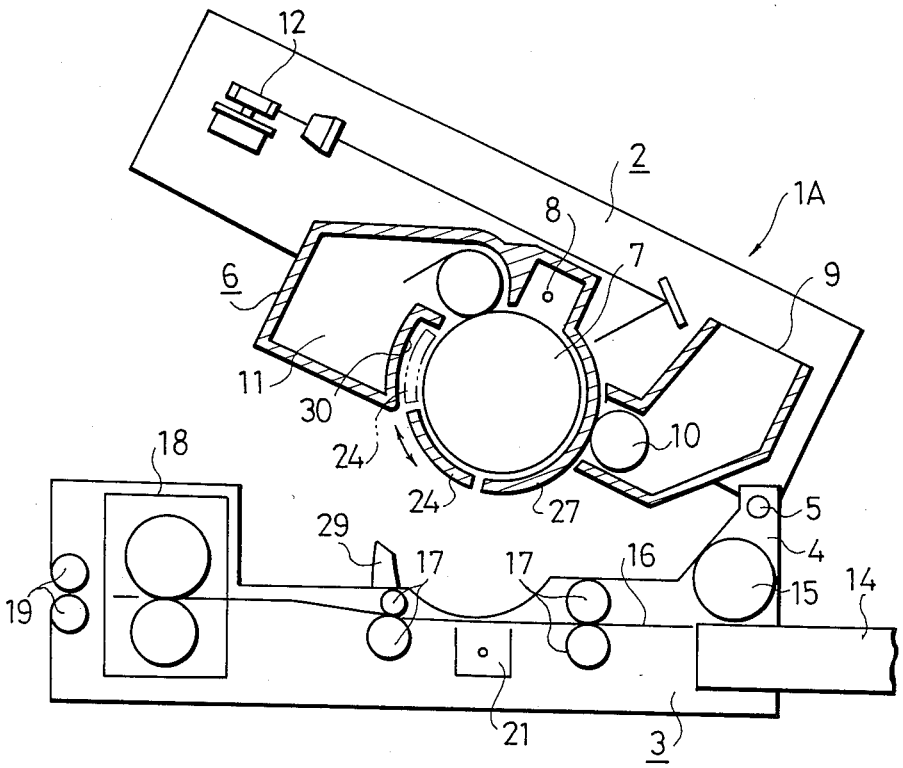
FIG. 1 is a schematic sectional front view showing an embodiment of an electrophotographic apparatus according to the present invention.

The present invention will now be described with reference to its embodiment shown in the drawings, in which the same component as that of the conventional apparatus is indicated by the same reference numeral with its description omitted.

Figure 2:
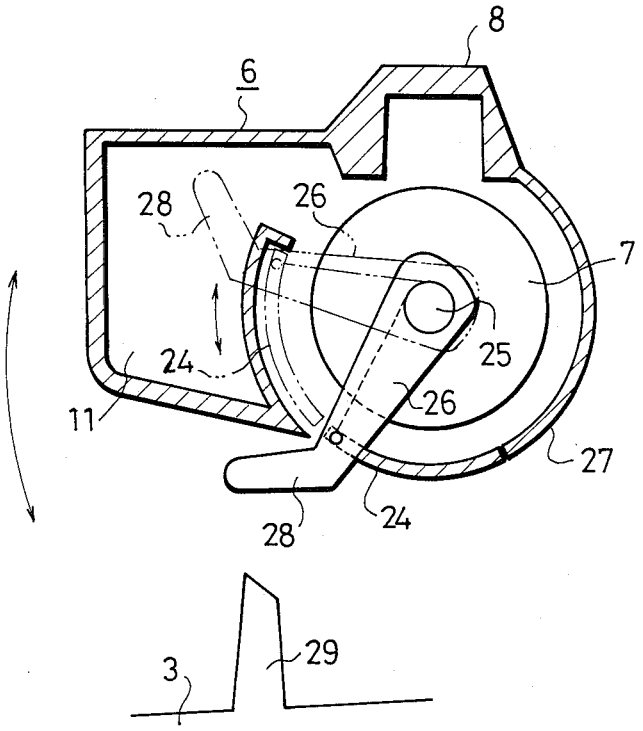
FIG. 2 is an enlarged view of the important portion of FIG. 1.
Figure 3:
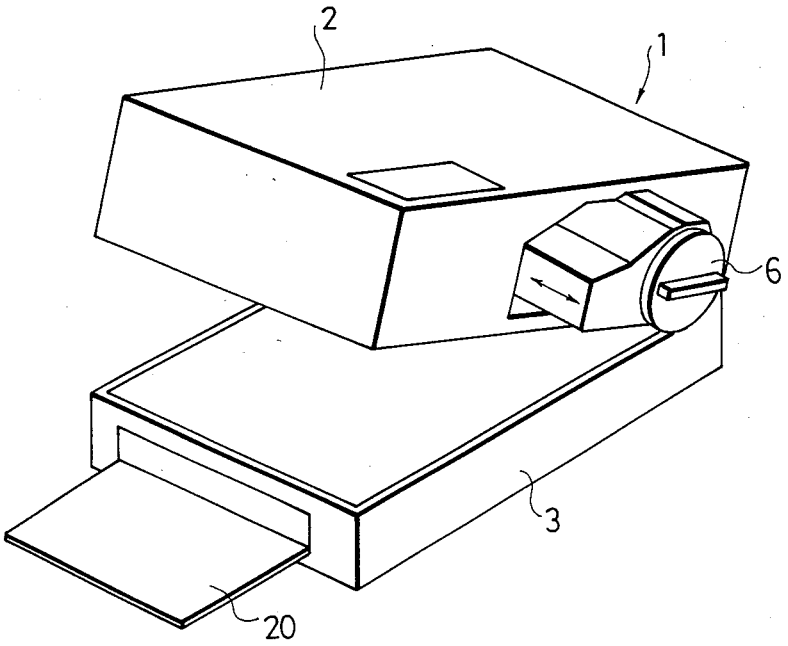
FIG. 3 is a perspective view showing the general shell-open type of electrophotographic apparatus.
Figure 4:
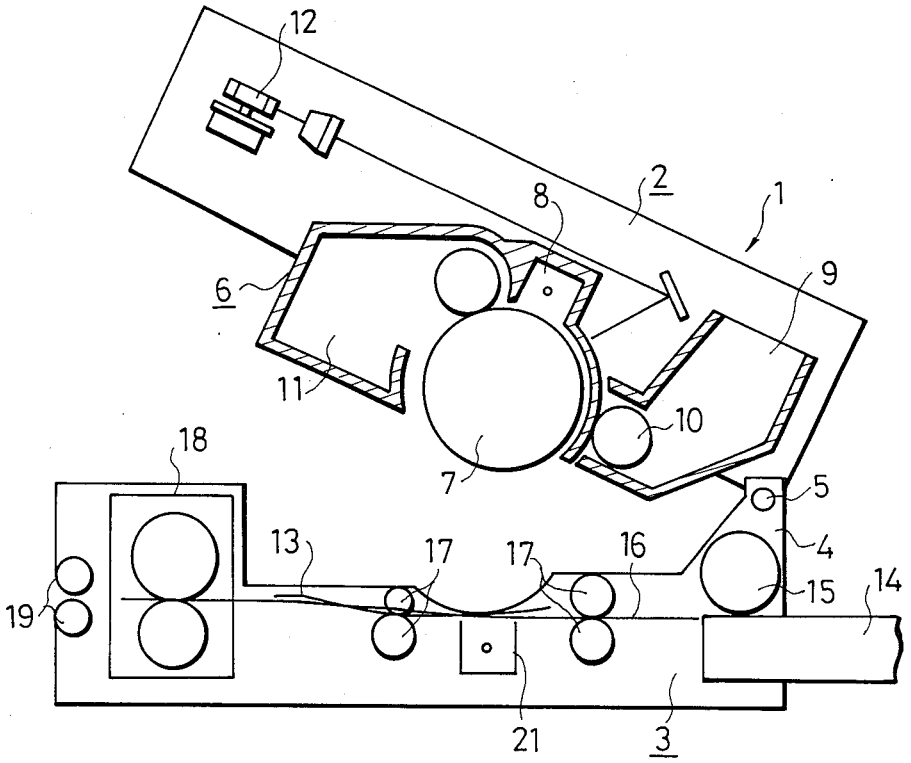
Fig. 4 PRIOR ART
FIG. 4 is a schematic vertical sectional front view showing an example of the conventional electrophotographic apparatus.
Figure 5:
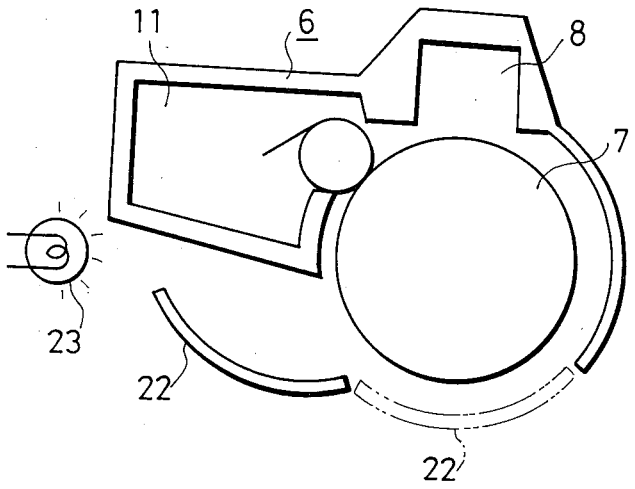
Fig. 5 PRIOR ART
FIG. 5 is a vertical sectional front view of an important portion showing another example of the conventional electrophotographic apparatus.

FIG. 1 shows an embodiment of an electrophotographic apparatus 1A according to the present invention, in which a membrane light emitting element ( for example, EL: electroluminescence element ) 24 is provided for eliminating residual potential on the sensitizing drum 7. This membrane light emitting element 24 is of the form of an arc whose diameter is a little larger than the outer diameter of the sensitizing drum 7 and as shown in FIG. 2, is attached at one end to a lever 26 supported swingably by a support shaft 25 whose axial center coincides with that of the sensitizing drum 7. In the unrestricted state the point of the lever 26 is lowered, so that the membrane light emitting element 24 attached to the support shaft 25 is in abutment on a casing 27 of the cartridge unit 6, thus closing the lower part of the sensitizing drum 7.

The lever 26 has a bent portion 28 at its point. When the upper unit 2 is closed this bent portion 28 comes into contact with a projection 29 provided on the upper face of the lower unit 3 to rotate the lever 26 clockwise in FIG. 2. Incidentally, the cleaner 11 has a recess 30 provided on the side of the sensitizing drum 7 for accommodating the membrane light emitting element 24.

According to the foregoing configuration, as the upper unit 2 is closed to touch the lower unit 3, the projection 29 of the lower unit 3 comes into touch with the bent portion 28 of the lever 26 to rotate the lever 26 clockwise, so that the membrane light emitting element 24 attached to the lever 26 is positioned inside the recess 30 of the cleaner 11 as illustrated by the imaginary line of FIG. 1. As a result, the lower part of the sensitizing drum 7 is opened, thereby permitting execution of the foregoing electrophotographic process.

If jamming of some recording paper 13 occurs, the recording paper 13 is taken out by opening the upper unit 2. At this time, the lever 26 comes out of engagement with the projection 29 of the lower unit 3, the lever 26 revolves counterclockwise due to its own weight, and the membrane light emitting element 24 attached to the lever 26 abuts on the casing 27 of the cartridge unit 6 and stops. Accordingly, when removing the recording paper 13 the lower part of the sensitizing drum 7 is closed by the membrane light emitting element 24; thus, a possibility that the light falls on the sensitizing drum 7 or the hand touches erroneously the sensitizing drum 7 can be avoided.

Therefore, according to the embodiment, in addition to the feature that the sensitizing drum 7 is protected by the membrane light emitting element 24, this membrane light emitting element 24 can move round the sensitizing drum 7 and retract into the recess 30 formed in the cleaner 11 when necessary; thus, the apparatus can be miniaturized.

As described hereinabove, according to the present invention, the lower part of the sensitizing drum is protected by the membrane light emitting element without employment of a peculiar cover; thus, miniaturization of the apparatus can be achieved advantageously.

What is claimed is:

1. An electrophotographic apparatus having an upper unit which is openable and closable with respect to a lower unit, the upper unit carrying a photosensitive drum and a de-electrifying light source for eliminating residual potential on said photosensitive drum, wherein the improvement comprises said drum having a lower portion facing the lower unit, said de-electrifying light source being a membrane light emitting element disposed at an operative position of said drum, and said membrane light emitting element being movable to the lower portion of said drum when the upper unit is opened from the lower unit to protect said photosensitive drum.

2. An electrophotographic apparatus according to claim 1, wherein said membrane light emitting element is of the form of an arc concentric with said photosensitive drum and is mounted rotatably about the center of said photosensitive drum.

3. An electrophotographic apparatus according to claim 2, wherein said membrane light emitting element is attached to a lever pivotable about the center of said photosensitive drum, and said lever is pushed up by said lower unit and said membrane light emitting element is retracted in a recess formed in said upper unit when said upper unit is closed.

* * * * *